US005880417A

United States Patent [19]

Koh

[11] Patent Number: 5,880,417

[45] Date of Patent: Mar. 9, 1999

[54] SYNCHRONOUS POSITION CORRECTION APPARATUS FOR ELEVATOR

[75] Inventor: Eun-Man Koh, Changwon, Rep. of Korea

[73] Assignee: LG Industrial Systems Co., Ltd., Seoul, Rep. of Korea

[21] Appl. No.: 794,535

[22] Filed: Feb. 3, 1997

[30] Foreign Application Priority Data

Feb. 7, 1996 [KR] Rep. of Korea ..... 2956/1996

[51] Int. Cl.[6] ..... B66B 1/34

[52] U.S. Cl. ..... 187/394; 187/282

[58] Field of Search ..... 187/247, 248, 187/282, 394, 391, 393

[56] References Cited

U.S. PATENT DOCUMENTS

| | | | |
|---|---|---|---|
| 4,387,436 | 6/1983 | Katayama et al. | 364/561 |
| 4,436,185 | 3/1984 | Ludwig et al. | 187/29 R |
| 4,673,062 | 6/1987 | Ishii | 187/134 |
| 4,716,517 | 12/1987 | Iwata | 364/148 |
| 4,832,159 | 5/1989 | Ikejima et al. | 187/129 |
| 4,898,263 | 2/1990 | Manskie et al. | 187/133 |
| 5,012,899 | 5/1991 | Iwata | 187/101 |
| 5,313,026 | 5/1994 | Youla et al. | 187/134 |
| 5,373,122 | 12/1994 | Henry | 187/394 |

*Primary Examiner*—Robert E. Nappi
*Attorney, Agent, or Firm*—Oliff & Berridge, PLC

[57] ABSTRACT

An improved synchronous position correction apparatus for an elevator which is capable of safely escaping passengers from a car when a synchronous position error occurs in the elevator by moving the car to a neighboring floor and correcting the synchronous position error by using a floor height value of a neighboring floor, for thus normally operating the elevator system. The apparatus includes a car controller for controlling the operation thereof, a floor number switch disposed in each floor for storing a floor number of a corresponding floor, a floor controller for receiving and storing a floor number from the floor number switch, outputting the floor number when a synchronous position error occurs, and checking an opening/closing state of an elevator door, and a main controller for communicating with the car controller and the floor controller, controlling the operation of the elevator, receiving the synchronous position error from the floor controller, moving the car to a neighboring floor, receiving the floor number of the neighboring floor from the floor controller, and correcting the synchronous position a floor height value of the floor.

5 Claims, 4 Drawing Sheets

SYNCHRONOUS POSITION CORRECTION APPARATUS FOR ELEVATOR

BACKGROUND OF THE INVENTION

1. Field of the Invention

The present invention relates to a synchronous position correction apparatus for an elevator, and in particular to an improved synchronous position correction apparatus for an elevator which is capable of safely escaping passengers from a car when a synchronous position error occurs in the elevator by moving the car to a neighboring floor and correcting the synchronous position error by using a floor height value of a neighboring floor, for thus normally operating the elevator system.

2. Description of the Conventional Art

FIG. 1 is a diagram illustrating a conventional position control apparatus for an elevator.

As shown therein, the conventional position control apparatus for an elevator includes shielding plates 4A through 4N spacedly disposed in one inner wall of a lifting/lowering path 1, a position detector 3 having a permanent magnet 3A and a lead switch 3B and being disposed in an upper portion of a car 2 for outputting a position detection signal by an interaction with the shielding plates 4A through 4N, an encoder 10 for generating pulses matching with the number of rotations of a motor 9, a main controller 6 for controlling the entire operation of the elevator by outputting a speed command V* for moving the car 2 to a predetermined floor based on the output signals from the position detector 3 and the encoder 10 when a call from the floor or the car 2 is registered, a motor controller 7 for controlling the speed and current of the motor 9 in accordance with the speed command V*, and an inverter 8 for supplying a driving phase voltage to the motor 9 in accordance with the control of the motor controller 7.

The operation for measuring the floor height value of the elevator by using the main controller 6 when initially installing the elevator will now be explained.

When the car 2 is downwardly moved, the car 2 is stopped by a down limit switch DLS, and the car 2 is upwardly moved.

During the running of the elevator, when magnetic field generated by the permanent magnet 3A is shielded by the shielding plates 4A through 4N, the lead switch 3B is turned off. Therefore, the voltage of 48V, which is being supplied to the main controller 6, is blocked. The number of accumulated pulses from the encoder 10 and the number of pulses corresponding to half (125 mm) the length (250 mm) of the shielding plates are added, and the resultant value is stored as the floor height value of a corresponding floor.

When an up limit switch ULS is operated, it is recognized that the storing of the floor height value is finished.

As described above, at the initial stage, the output pulses from the encoder are accumulatively stored in accordance with the running direction (for example, the up movement direction) and recognizes the synchronous position of the car. When a car call occurs, the car is moved in response to the car call, and the synchronous position causes to generate a speed pattern in response to the call, and the speed pattern is used for controlling the position of the car.

In addition, an accurate arriving at a desired floor and an accurate synchronous position must be obtained for preventing the motor from being over-loaded and any accidents to the passengers. However, during the services of the car, there may occur errors due to an external cause. If the error value of the synchronous position exceeds a predetermined level, the normal operation of the car can not be obtained, and the emergency operation is performed.

The absolute position of the car is detected by a hardware sensor, and the car is moved to a neighboring floor, and the door of the elevator is opened, for thus safely escaping the passengers from the car. Thereafter, the synchronous position is corrected, and the elevator is normally operated.

Namely, referring to FIG. 1, if the error value of the synchronous position exceeds a predetermined value, the car is downwardly moved at low speed. When the down limit switch DLS is operated, the car 2 is stopped. When the car 2 is stopped, the synchronous position is corrected as the value related to the position of the down limit switch DLS. Thereafter, the car is normally operated again.

However, in a state that the current position of the car is far from the down limit switch DLS, if a synchronous position error occurs, since the car is moved down to the down limit switch DLS at low speed, during the operation of the car, the passengers must stay in the erroneous car, for thus increasing the electric power consumption.

In order to overcome the above-described problems, a current floor detector is provided for judging the current position of the car.

FIG. 2 is a diagram illustrating a conventional current floor detector for an elevator.

As shown therein, a decelerator 21 is driven by a rope 28 connected with a car 2. A chain 22 is upwardly and downwardly moved by the decelerator 51. A support member 23 connected to the chain 22 and a segment 24 fixed to the support member 23 is upwardly/downwardly moved. A floor detection segment 25 is installed based on the gear formation ratio of the decelerator 21 and is matched with the floor height of a building. Here, two segments 24 and 25 are made of a conductive material. The operation of the current floor detector 20 will now be explained.

When the car 2 is operated, the chain 22 connected with the decelerator 21 is upwardly/downwardly moved, and thus the support member 23 and the segment 24 are upwardly/downwardly moved. When the segment 24 contacts with the floor detection segment 25, the voltage of 48V is supplied to the main controller 6, or the voltage is not supplied thereto. The main controller 6 judges where the car is positioned based on the voltage supply state.

If a synchronous position error occurs, and the floor detection segment 25 of a corresponding floor is operated, the main controller 6 updates the position of the actual floor in which the car 2 is positioned, namely, the current floor is updated, and the synchronous position is corrected as a floor height value of the updated current floor.

After the correction is made, the car is normally operated again.

As described above, if there is provided the current floor detector 20, it is possible to correct the synchronous position in a neighboring floor near which the error occurred. For the corrections above, the decelerator, the rope connected with the car, and the hardware apparatus such as a current floor detector are necessary. In addition, it is necessary to set the fixing position of the floor detection segment and the distance between the floor detection segments which are proportional with respect to the actual height of each floor. In addition, it is further necessary to accurately set the entire length of the current floor detector and the gear formation ratio of the decelerator based on the distance between the uppermost floor and the lowermost floor.

Therefore, in order to install the above-described elements, the fabrication cost is increased. In addition, after the installation of the elevator is made, the above-described values must be accurately set. As the number of floors of a building is increased, it is difficult to install related elements.

SUMMARY OF THE INVENTION

Accordingly, it is an object of the present invention to provide a synchronous position correction apparatus for an elevator which overcomes the aforementioned problems encountered in the conventional art.

It is another object of the present invention to provide an improved synchronous position correction apparatus for an elevator which is capable of safely escaping passengers from a car when a synchronous position error occurs in the elevator by moving the car to a neighboring floor and correcting the synchronous position error by using a floor height value of a neighboring floor, for thus normally operating the elevator system.

To achieve the above objects, there is provided a synchronous position correction apparatus for an elevator which includes a car controller for controlling the operation thereof, a floor number switch disposed in each floor for storing a floor number of a corresponding floor, a floor controller for receiving and storing a floor number from the floor number switch, outputting the floor number when a synchronous position error occurs, and checking an opening/closing state of an elevator door, and a main controller for communicating with the car controller and the floor controller, controlling the operation of the elevator, receiving the synchronous position error from the floor controller, moving the car to a neighboring floor, receiving the floor number of the neighboring floor from the floor controller, and correcting the synchronous position a floor height value of the floor.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
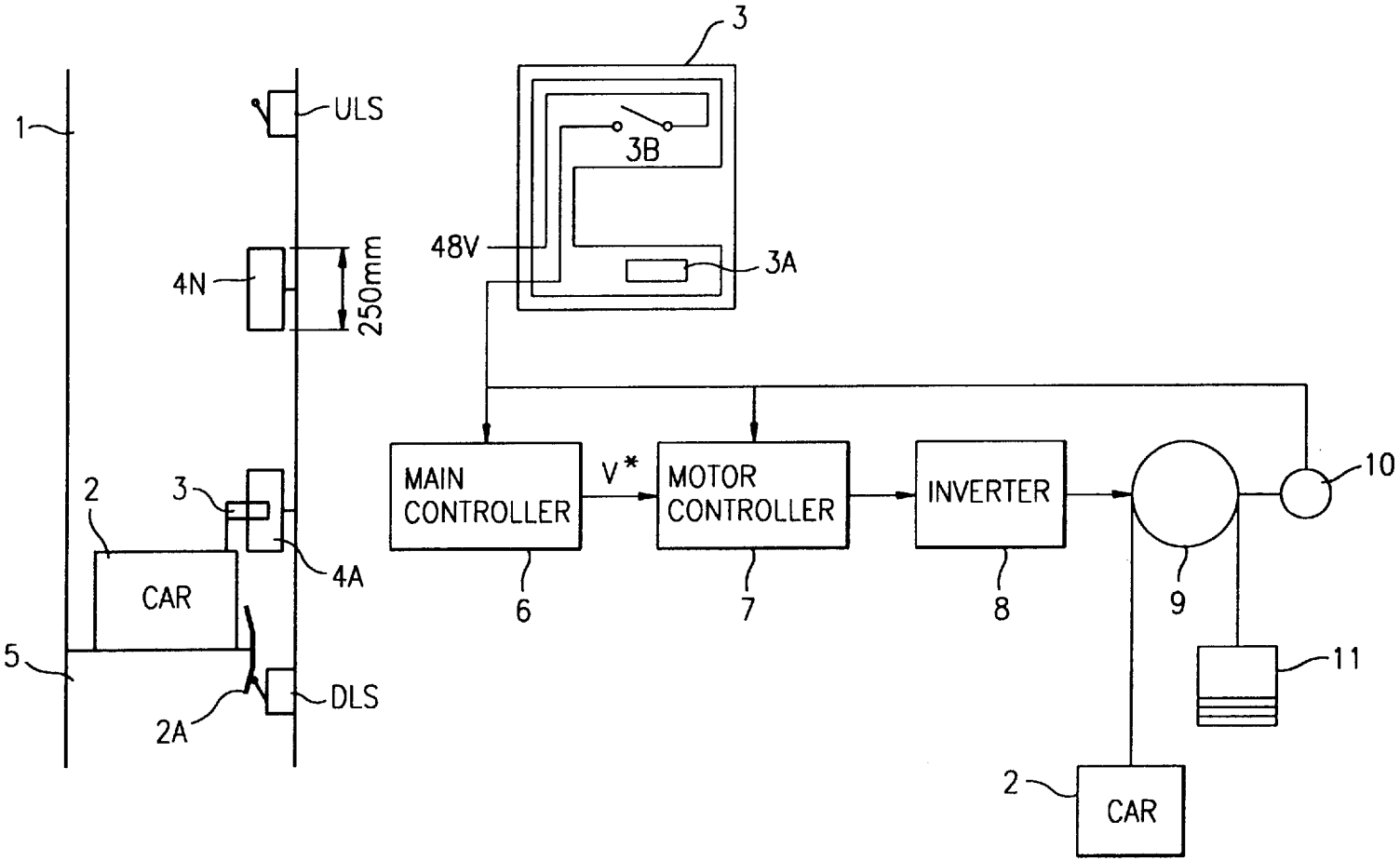
FIG. 1 CONVENTIONAL ART
FIG. 1 is a diagram illustrating a conventional position control apparatus for an elevator.
Figure 2:
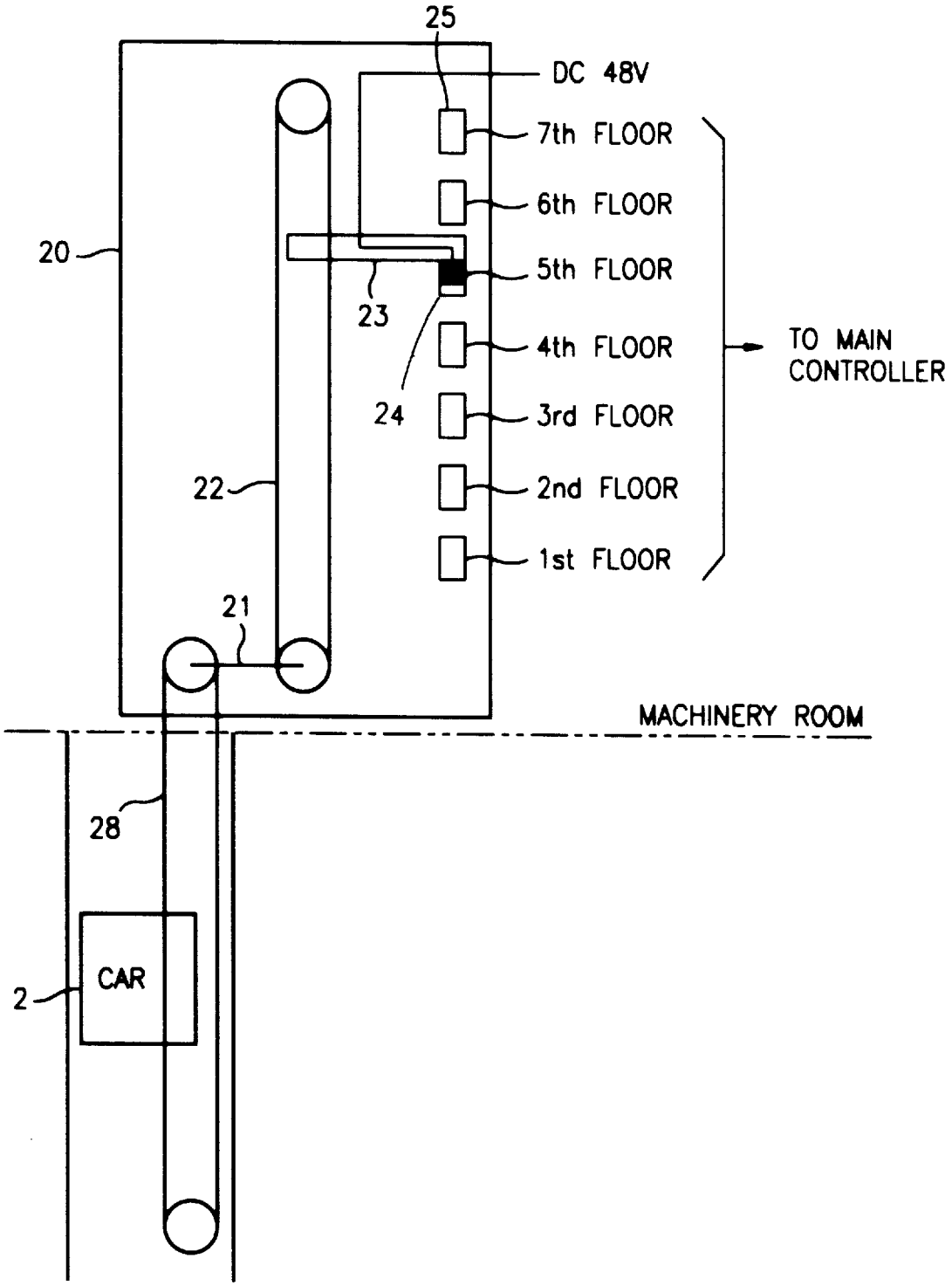
FIG. 2 CONVENTIONAL ART
FIG. 2 is a diagram illustrating a conventional current floor detector for an elevator.
Figure 3:
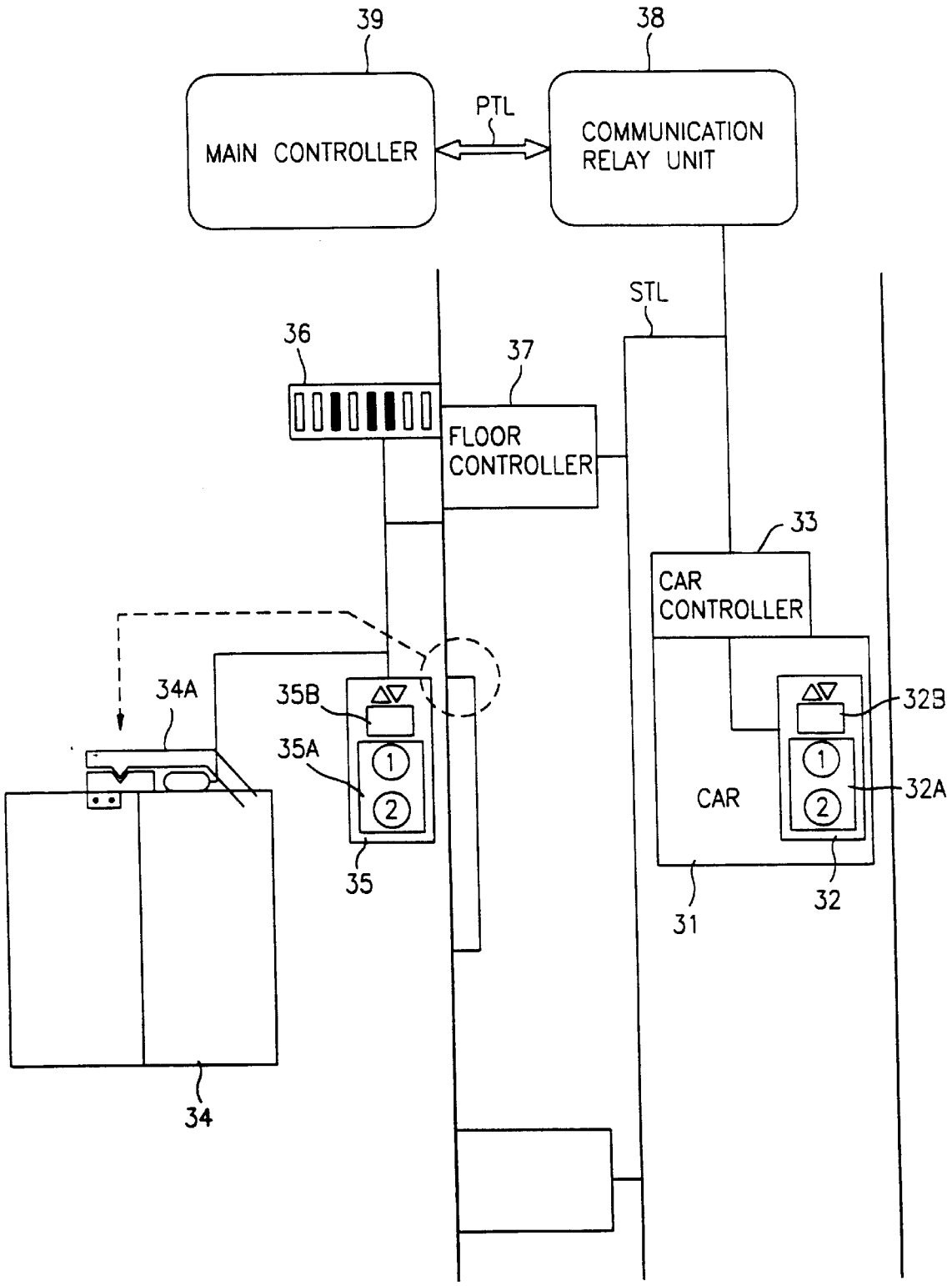
FIG. 3 is a diagram illustrating a synchronous position correction apparatus for an elevator according to the present invention.

FIG. 3 is a diagram illustrating a synchronous position correction apparatus for an elevator according to the present invention.

As shown therein, the synchronous position correction apparatus for an elevator according to the present invention includes a car controller 33 for transmitting a call information from a car call register 32 disposed in a car 31 to a communication relay unit 38 in series and for displaying an information such as a call registration and an operation direction of the car on the car call register 32, a floor number switch 36 disposed in each floor for storing a floor number of the floor, a limit switch 34A for being operated in accordance with the opening/closing state of an elevator door, a floor controller 37 for detecting the opening/closing state of the door of a floor 34 by using the limit switch 34A, transmitting a call registration state from a floor call register 35 through the communication relay unit 38 in series, and outputting the floor number information from the floor number switch 36 to the communication relay unit 38 in series when a synchronous position error occurs, the communication relay unit 38 for communicating with the car controller 33 and the floor controller 37 through a serial transmission line STL in series and for communicating in parallel with a main controller 39 through a parallel transmission line PTL, the main controller 39 for communicating with the car controller 33 and the floor controller 37 through the communication relay unit 38, controlling the entire operation of the elevator, receiving a floor number information from the floor controller 37 after the car 31 is moved to a neighboring floor when detecting the synchronous position error, and correcting the synchronous position as the floor height value of a corresponding floor.

The operation of the synchronous position correction apparatus of the elevator according to the present invention will now be explained with reference to FIG. 4.

Figure 4:
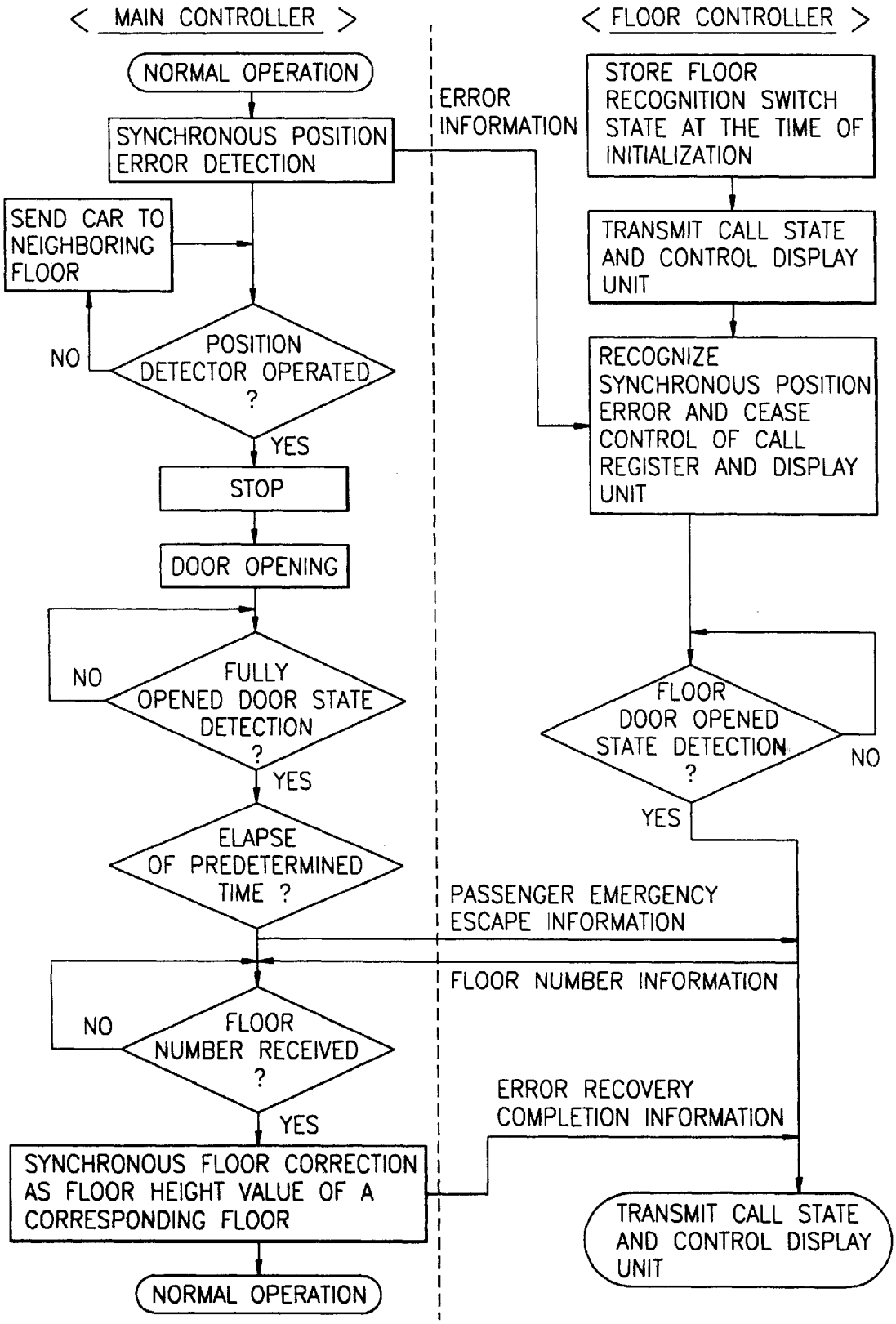
FIG. 4 is a flow chart of a synchronous position correction method for an elevator according to the present invention.

FIG. 4 is a flow chart of a synchronous position correction method for an elevator according to the present invention. As shown therein, the left side flow chart denotes the operation method of the main controller 39, and the right side flow chart denotes the operation method of the floor controller 37.

When the electric power is initially supplied to the elevator system, the floor controller 37 sequentially receives floor number values set in the floor number switch 36, and the floor number values are stored in an internal memory device.

The floor number switch 36 is a dip switch in which the floor number of a corresponding floor is set when installing the elevator system.

Next, the normal operation of the car will now be explained.

When a passenger pushes a call switch 35A of the floor call register 35, the floor controller 37 recognizes the call registration of the floor call register 35, and turns on a call lamp 35B, so that a passenger can recognize that a call is registered.

In addition, the floor controller 37 detects whether the limit switch 34A is turned on/off and transmits the detected information to the communication relay unit 38 in series through the serial transmission line STL, and the communication relay unit 38 transmits the information to the main controller in parallel through the parallel transmission line PTL.

When a passenger in the car 31 pushes the call registration switch 32A of the car call register 32, the car controller 33 transmits an information matching with the call to the communication relay unit 38 in series through the serial transmission line STL and turns on the lamp of the call registration switch 32A, for thus recognizing a state that the call is registered, and the floor number of the current car is displayed on the floor number display unit 32B of the car 31.

When the synchronous position error occurs during the normal operation of the elevator car, the main controller 39 detects the error, and the error occurrence state is reported to the floor controller 37 of the floor. The floor controller 37 does not process the call information from the floor call register 35 and does not perform the display operation based on the call.

In the above-described state, the main controller 39 downwardly moves the car at low speed, and when the car arrives at a neighboring floor, the position detector detects the car. The door is fully opened for a predetermined time.

Here, the predetermined time is provided in order for the passengers in the car to safely escape from the car. The floor controller 37 detects whether the floor door is opened through the limit switch 34A, and the door open information is transmitted to the main controller 39.

After a predetermined time, the state that the passengers are safely escaped from the car is transmitted to the floor controller 37 of each floor, and the floor controller 37 of the floor in which the passengers were escaped transmits the floor number which was outputted from the floor number switch 36 to the main controller 39.

The main controller 39 corrects the synchronous position as the floor height value of a corresponding floor, and a recovery finished information is transmitted to the floor controller 37 of each floor, so that an information which denotes that the error was successfully recovered is transferred to corresponding elements, and thus the elevator car 31 is normally operated again.

In addition, the floor controller 37 stops the output of the information related to the state of the floor door in accordance with the received recovery completion information and controls the call information a display information.

As described above, the synchronous position correction apparatus for an elevator according to the present invention has a floor number switch for detecting the floor number of each floor. The floor controller, which controls the floor information, has a function for detecting the state of the floor door of each floor. When a synchronous position error occurs, the car is moved to a neighboring floor for escaping the passengers in the car, for thus safely escaping the passengers from the car. The floor controller disposed in the floor transmits the floor number to the main controller, and the main controller corrects the current synchronous position based on the received floor number. Thereafter, the car is normally operated.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A synchronous position correction apparatus for an elevator which corrects a synchronous position when a synchronous position error of an elevator car occurs, comprising:

a car controller for controlling the operation thereof;

a floor number switch disposed in each floor for storing a floor number of a corresponding floor;

a floor controller for receiving and storing a floor number from the floor number switch, outputting the floor number when a synchronous position error occurs, and checking an opening/closing state of an elevator door; and a main controller for communicating with the car controller and the floor controller, controlling the operation of the elevator, receiving the synchronous position error from the floor controller, moving the car to a neighboring floor, opening the elevator door for a predetermined time at the neighboring floor after the synchronous position error occurs, receiving the floor number of the neighboring floor from the floor controller, and correcting the synchronous position to a floor height value of the floor.

2. The apparatus of claim 1, further comprising a communication relay unit for communicating with the car controller and the floor controller in series, communicating with the main controller in parallel, and transmitting and receiving information.

3. The apparatus of claim 1, wherein said floor controller checks the opening/closing state of the door by using a limit switch which is operated in accordance with the opening/closing state of the floor door.

4. The apparatus of claim 1, wherein said floor number switch includes a dip switch.

5. A method for correcting a synchronous position of an elevator car when a synchronous position error occurs, the elevator car having a door and servicing a series of floors with each floor having a unique floor number, the method comprising the steps of:

identifying a current floor number of the floor at which the elevator car is located;

detecting the synchronous position error;

moving the elevator car, after detecting the synchronous position error, to a neighboring floor relative to the floor identified as the current floor number;

opening the door for a predetermined time at the neighboring floor; and correcting the synchronous position of the elevator car based upon a floor height value of the neighboring floor.

* * * * *